United States Patent [19]

Smith

[11] 4,027,467

[45] June 7, 1977

[54] UNIROLL FALSE TWIST DEVICE AND METHOD

[76] Inventor: Joseph F. Smith, 1901 E. Wendover Ave., Greensboro, N.C. 27405

[22] Filed: June 4, 1976

[21] Appl. No.: 692,650

[52] U.S. Cl. ..... 57/77.4; 57/34 HS; 57/106; 57/157 TS

[51] Int. Cl.[2] ..... D02G 1/04; D01H 7/92

[58] Field of Search ..... 57/34 R, 34 HS, 77.3, 57/77.4, 77.45, 157 R, 157 TS, 106

[56] References Cited

UNITED STATES PATENTS

| | | | |
|---|---|---|---|
| 3,287,890 | 11/1966 | McIntosh et al. | 57/77.4 |
| 3,296,786 | 1/1967 | Wyatt | 57/34 HS |
| 3,327,463 | 6/1967 | Niina et al. | 57/77.4 |

*Primary Examiner*—Donald Watkins

[57] ABSTRACT

An apparatus and method for applying a false twist to a continuously traveling synthetic yarn by engaging the yarn along a directed path of travel with a uniroll member having a plurality of axially spaced yarn contacting surfaces bearingly supported for rotation about an axis, and yarn guide means for engaging and retaining the continuously traveling yarn along its predetermined path of contacting travel against the spaced yarn contacting members to impart a twist to the yarn in a substantially helical path from initial engagement to disengagement with the uniroll device to impart a false twist to the yarn.

12 Claims, 11 Drawing Figures

UNIROLL FALSE TWIST DEVICE AND METHOD

BRIEF SUMMARY AND OBJECTS OF THE PRESENT INVENTION

This invention relates generally to an apparatus and method for applying a false twist to a continuously traveling synthetic yarn by engaging the yarn and imparting a false twist by frictional contact with a series of yarn-engaging surfaces mounted to rotate in unison and the yarn path is substantially helical while engaging the yarn-contacting surfaces of a uniroll device that is bearingly supported for driven rotation about its axis.

Various types of friction twisting devices are presently available in which spaced-apart disks or grooved rollers may be utilized to impart a false twist to a yarn that travels continuously between pairs of interengaging disks or rollers, as disclosed, for example, in U.S. Pat. Nos. 1,030,179; 2,936,570; 2,939,269; 3,668,853; 3,762,149; 3,788,057; 3,921,379, among others. The primary function of the interengaging friction disks permits slippage of the yarn which results in variation of the number of turns in the yarn per unit length thereby producing irregularities which become more pronounced after dyeing, and very discernible in the knitted or woven fabric. In some applications, the friction disks are mounted to engage the yarn on only one side and the yarn is not retained in a nonslipping engagement with the disks.

The friction twisting apparatus and method of the present invention utilizes a single cylindrical roller in which there is a series of yarn-engaging surfaces that are axially-spaced apart and mounted on a single shaft for rotation with the single roll being denominated as a "uniroll." It has been found advantageous to provide a substantially helical path of travel for the continuously moving yarn from engagement to disengagement with the uniroll by means of yarn-engaging members that urge the yarn against the peripheral frictional surfaces of the spaced circular segments on the uniroll that rotate at the same angular velocity. Suitable yarn guide members are positioned at the inlet and exit to the uniroll to maintain the continuously traveling yarn in a predetermined path of travel without utilizing a cooperating yarn engaging set of revolving surfaces as disclosed in one or more of the aforementioned patents.

One of the primary objections of the present invention is the provision of a uniroll device for false twisting a continuously traveling yarn to impart a false twist by direct frictional contact without any auxiliary rotatable yarn contacting surfaces.

Another objective of the present invention is the provision of a method for imparting a false twist to a continuously traveling yarn by urging the yarn into frictional engagement with a plurality of yarn engaging surfaces that rotate in unison on the same axis while engaging the yarn to form a substantially helical contour at a desired angle of contact as it passes through engagement with the uniroll false twist member.

A further object of the invention is the provision of a friction twist uniroll device wherein the yarn to be processed is drawn over the periphery of a series of circular segments that are axially spaced-apart with stationary means for maintaining yarn contact with the circular segments to eliminate substantial slippage between the yarn contacting circular segments and the yarn being twisted.

Other objects and advantages of the invention will become readily apparent when considered in view of the following detailed description of several preferred embodiments taken in conjunction with the accompanying claims which are not intended to be limited to the embodiments disclosed.

BRIEF DESCRIPTION OF DRAWING FIGURES

Figure 8:
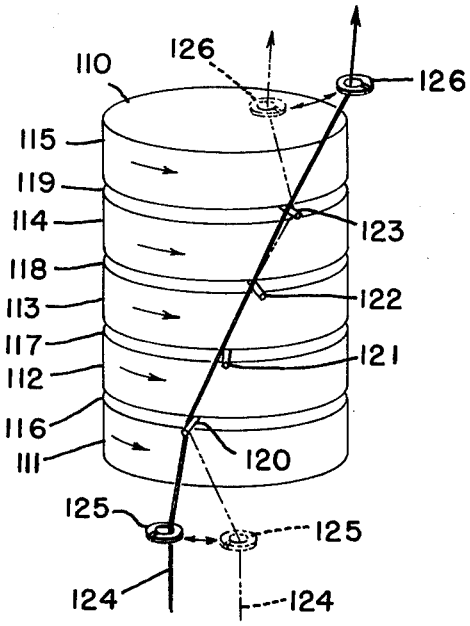
Figure 9:
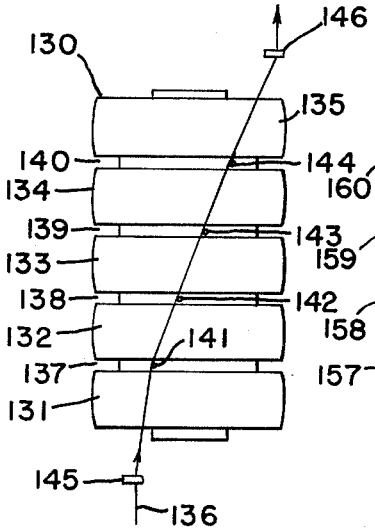
Figure 10:
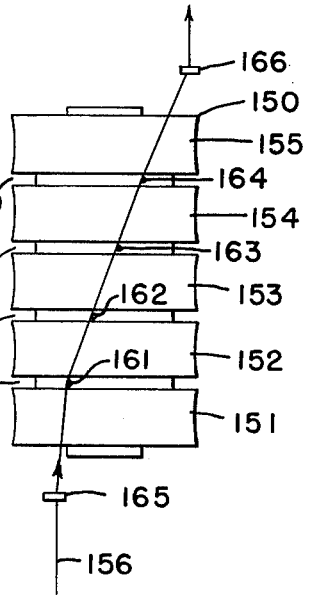

FIG. *7a* is a diagrammatic perspective view of a single roll with spaced-apart vertically aligned yarn guides associated therewith;

FIG. *7b* is a diagrammatic perspective view of a single roll with spaced-apart vertically offset yarn guides associated therewith;

FIG. 8 is a diagrammatic perspective view of a uniroll device with vertically spaced yarn-engaging guides and alternate positions for yarn entering and exit guides;

FIG. 9 is a side elevational view of an alternate embodiment of the uniroll yarn-engaging surfaces with spaced yarn guides; and FIG. 10 is a side elevational view of another alternate embodiment of the uniroll yarn-engaging surfaces with spaced yarn guides.

DETAILED DESCRIPTION OF PREFERRED EMBODIMENTS OF THE INVENTION

Figure 1:
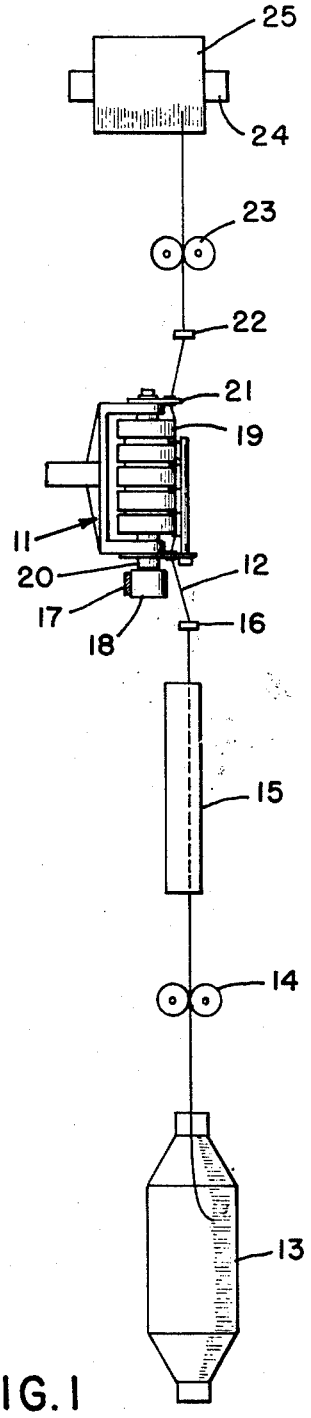
FIG. 1 is a schematic illustration of a threadline for a single position on a false twist yarn texturing apparatus incorporating the uniroll yarn twisting device embodying this invention.
Figure 4:
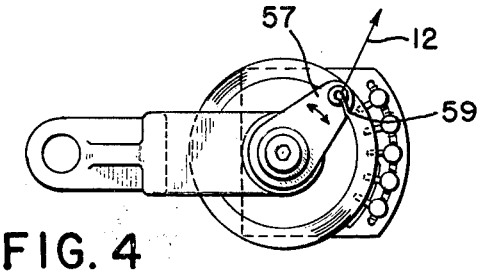
FIG. 4 is a top plan view of FIg. 2.

Referring to the drawings and particularly to FIG. 1, there is illustrated a threadline for a single position in a false twist apparatus of conventional construction in which the uniroll device 11 of the present invention engages a continuously traveling thermoplastic yarn 12 that is removed from the raw or feeder yarn supply package 13. The yarn 12 removed from the package 13 passes between a pair of feed rolls 14 which apply the desired underfeed or overfeed depending upon the type of yarn being supplied to be textured. The yarn 12 passes through a heating member 15 where it is subjected to an elevated temperature sufficient to plasticize the yarn which is in a twisted state by virtue of the twist imparted to the yarn by the uniroll false twist device 11. The twist in the yarn 12 extends upstream from the uniroll false twist device 11 past the yarn guide 16 through the heating member 15 to the feed rolls 14.

A continuously traveling belt 17 mounted on the false twist frame (not shown) is driven at a constant linear velocity and engages the whorl 18 to which the uniroll member 19 is bearingly supported on the shaft 20. The yarn 12 passes across the uniroll false twist member 19 with its yarn-engaging surfaces in a substantially helical pattern and emerges through the yarn exit guide 21 before it passes through the stationary yarn guide 22 in its path of travel to the exit rolls 23 which are driven with appropriate overfeed or underfeed depending upon the properties of the yarn being textured. A suitable traverse (not shown) positions the yarn 12 on the rotating bobbin 24 to form a completed yarn package 25.

Figure 2:
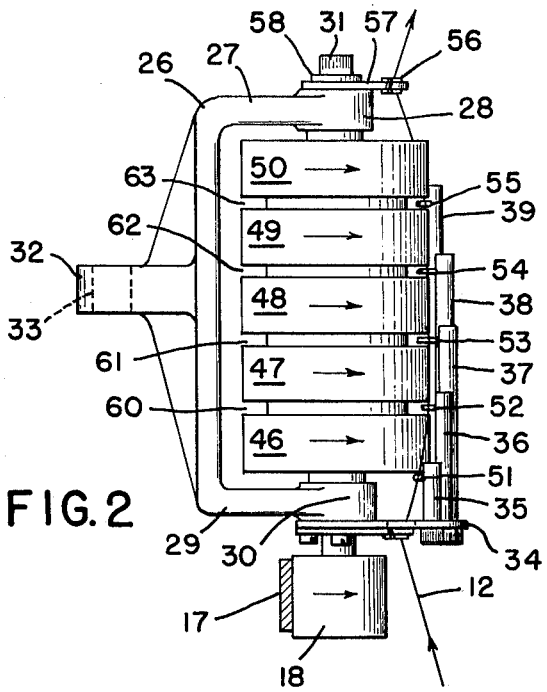
FIG. 2 is an enlarged side elevational view of the uniroll yarn twisting device illustrated in FIG. 1.
Figure 3:
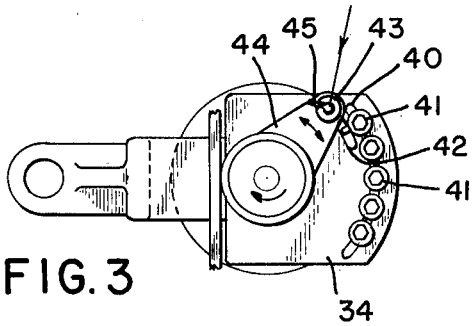
FIG. 3 is a bottom plan view of FIG. 2.
Figure 7A:
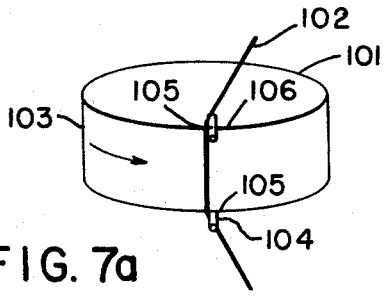
Figure 7B:
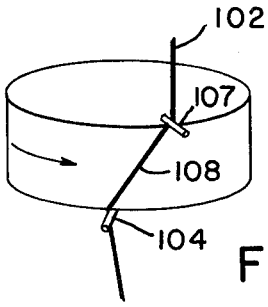

There is illustrated in FIG. 2 the uniroll device 11 of FIG. 1 in which the U-shaped 26 is provided with an upper arm 27 having a bearing housing 28, and a lower arm 29 having a bearing housing 30. Shaft 31 is rotatably supported in bearings in housings 28 and 30 for rotation through the pulley or whorl 18 that is driven by the belt 17. The central supporting leg 32 of the yoke 26 is provided with an opening 33 for anchoring the yoke 26 to a suitable mounting on the false twist machine.

A plate 34 is positioned beneath the housing 30 and extends outwardly to support a series of vertically extending rods 35, 36, 37, 38 and 39, each of which is adjustably positioned in the arcuate opening 40 machined in the plate 34 and supported in position by its respective supporting screw 41. A yarn guide opening 42 is positioned in the plate 34 to permit the passage of yarn 12 therethrough in cooperation with the yarn guide member 43 which is positioned at the outer extremity of the supporting yarn guide link 44 that is rotatably adjustable and cooperates with the plate 34 and the yarn opening 42. The yarn guide 43 has a yarn communicating slit 45 through which a yarn may be positioned within the guide 43 to facilitate threading. The relative position of the arm 44 may be modified depending upon the desired angle of approach to the series of yarn-engaging circular segments 46, 47, 48, 49, and 50.

Mounted on each of the rods 35 through 40 is a laterally projecting yarn-engaging pin 51 through 55, respectively, to engage the continuously traveling yarn 12 and guide it in a prescribed helical path against the rotating uniroll circular segments 46–50.

The pattern or prescribed path of travel of the yarn 12 across the series of circular segments 46–50 will depend upon the location and spacing of each of the pins 51 through 55. It has been found desirable to maintain a substantially straight angular path for the yarn although the specific angle may vary considerably. The specific angle will depend largely upon the denier of the yarn, the type of yarn, the material from which the circular segments are made, the speed of angular rotating of the uniroll, among other factors. It has been desirable, however, to employ a substantially dense or hard polyurethane for the uniroll circular segments which may be formed as one unit with the individual recesses 60–63 being machined to provide an appropriate undercut to receive the yarn guide pins 51–55 which may be ceramic or hard chrome finish. An exit yarn guide member 56 is positioned on the pivotable arm 57 that is mounted on the bushing 58 to orient the angle of discharge of the yarn 12 from the last circular segment 50. A slit 59 is provided in the arm 70 to facilitate threading through the yarn guide 56 supported on the 57.

The continuously traveling yarn 12 enters the uniroll device 11 through the yarn guide 43 and engages the first yarn-engaging pin 51 at an angular displacement relative to the entry of the yarn through the guide 43. The yarn 12 is urged against the periphery of the circular segment 46 and maintained against it in a helix preferably by means of the pins 51 and 52. It will be readily apparent that all of the circular segments 46 through 50 are mounted to rotate on the same axis and at the same angular velocity with each of the circular segments being spaced from each other by pin-receiving recesses 60, 61, 62 and 63.

Figure 5:
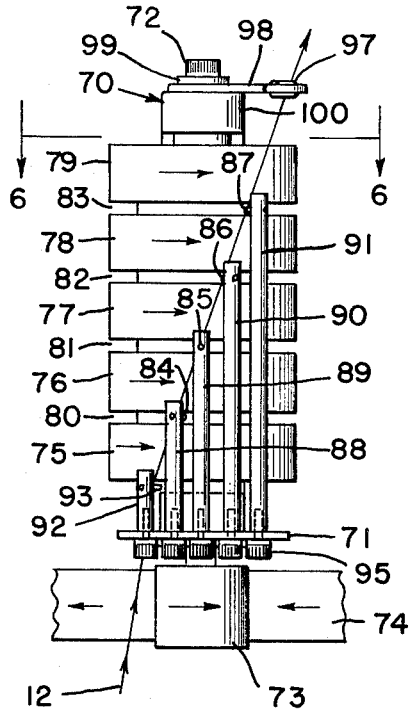
FIG. 5 is an end elevational view of a modified embodiment of a uniroll yarn twisting device embodying this invention.
Figure 6:
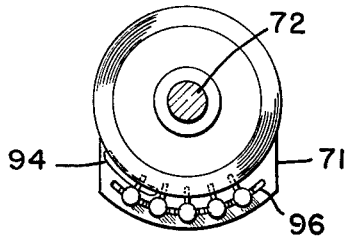
FIG. 6 is a top view of the uniroll yarn twisting device shown from the plane of line 6—6 of FIG. 5.

A modified embodiment of the uniroll false twist device 70 is shown in FIGS. 5 and 6 in which the plate 71 cooperatively receives and bearingly supports the rotatable shaft 72 that is rotated by having the pulley or whorl 73 mounted thereon. A drive belt 74 engages the periphery of the pulley 73 to rotate shaft 72 and each of the circular segments 75, 76, 77, 78, and 79 mounted thereon. Yarn guide receiving recesses 80, 81, 82, and 83 are positioned between the circular segments 75–79 to cooperatively receive in each recess one of the yarn-engaging pins 84, 85, 86, and 87 mounted on the vertically extending yarn element guide posts 88, 89, 90, and 91. The initial guide post 92 supports the yarn guide pin 93 directly below the circular segment 75 to receive the continuously traveling yarn 12 which will be guided upwardly through the arcuate yarn-receiving slot 94 in the plate 71. The posts 88–92 are adjustably retained in position by means of the screws 95 that pass through the arcuate slot 96 in the plate 71 so as to be laterally adjustable.

As shown in FIG. 5, the yarn 12 extends upwardly in a helical pattern across the yarn engaging circular segments 75–79 guided by the pins 84–87 and 93 to the discharge yarn guide 97 that is mounted pivotally on the yarn guide arm 98 which is supported on the bushing 99 surrounding the shaft 72 adjacent the upper boss 100.

There is illustrated in FIGS. *7a* a single circular segment 101 that is rotatable in a counterclockwise direction with a yarn 102 engaging the peripheral surface 103. A pair of vertically aligned and spaced-apart yarn guides 104 and 105 maintain the position of the yarn 102 in a rectilinear path as an element of a cylinder which imposes negligible twist to the traveling yarn since the main contact would be at the edges 105 and 106 of the circular segment with minimal twist being imparted in the medial portion between the edges 105 and 106. However, by displacing one of the yarn engaging pins 107 relative to the pin 104, the yarn 102 will then form a helix 108 between the pins 104 and 107 with the yarn 102 extending on the opposite side of the pin 107. In FIG. *7b*, the yarn 102 will have imparted to it a false twist by virtue of the substantial contact of the yarn at the circular segment edges and along the cylindrical surface depending upon the types of materials employed and their coefficient of friction.

In FIG. 8, there is illustrated a schematic diagram of uniroll 110 comprising five separate circular segments 111, 112, 113, 114 and 115 with intermediate recesses 116, 117, 118, and 119, respectively therebetween. A series of yarn guide members 120, 121, 122, and 123 is positioned in spaced vertical and offset relation to each other to guide a yarn 124 against the yarn engaging circular segments and to form a substantially helical yarn path of the desired angle. The inlet yarn guide member 125 may be displaced to the right as shown in outline form in the event of a modified false twist depending upon the type of yarn being processed and the material from which the uniform contact surfaces are fabricated. Similarly, the exit yarn guide 126 may be displaced to the left as shown in outline form to modify the yarn exit angle for optimum texturing results.

There is illustrated in FIG. 9, a further modified uniroll device 130 in which each of the circular segments 131 through 135 is provided with a convex yarn-engaging surface with intermediate yarn guide pine recesses 137 through 140 to receive the yarn guide pins 141 through 144, respectively. The yarn guide inlet 145 and yarn guide outlet 146 are shown in relative to the helical angle in the yarn path.

A further modified uniroll device 150 is illustrated in FIG. 10 in which the circular segments 151 through 155 are each provided with a concave surface with intermediate yarn engaging pin recesses 157 through 160 for cooperatively receiving the yarn pins 161 throuh 164. Appropriate inlet and exit yarn guides 165 and 166 are positioned externally of the uniroll assembly to achieve the desired helical angle for the yarn 156 as it passes across the yarn engaging surfaces.

It will be readily apparent that the helical angle may be determined and controlled by adjusting the yarn engaging elements as well as the inlet and outlet yarn guide members to achieve optimum results. In some applications, one or more of the yarn-engaging pins may be omitted. Furthermore, the displacement of the inlet and exit yarn guides may be displaced as shown in FIG. 8 depending upon the end characteristics desired for the particular yarn to be textured.

Significantly, the speed of rotation of the uniroll is minimal or bearing wear in view of the very substantial difference in radii between the circular segments and the yarn being twisted. In some applications, it is estimated that in excess of 750,000 rpm equivalent to a conventional false twist spindle is achieved with 750 denier polyester yarn, and very substantially increased throughput may be obtained at higher speeds depending upon the materials being processed. Yarns processed using the uniroll false twist member have negligible filament breakage with maximum uniformity of twist.

The uniroll device may be mounted directly on conventional false twist machines without substantial modifications to existing apparatus.

I claim:

1. A uniroll device for false twisting a continuously traveling yarn comprising; a rotatably bearingly supported driven member for engaging and twisting a continuously traveling yarn, said yarn-engaging and twisting member having a plurality of spaced-apart circular segments, said member having yarn guide means receiving recesses therebetween, yarn guide means including a series of adjustably positioned yarn-engaging spaced-apart members projecting inwardly and spaced from said circular segments in juxtaposition to and cooperatively aligned with said yarn guide receiving recesses and cooperatively supported for engaging and retaining a continuously traveling yarn along a predetermined substantially rectilinear path of contacting travel against said plurality of spaced-apart circular segments and maintaining said traveling yarn outside said recesses whereby a false twist is imparted to the continuously traveling yarn upon rotation of said driven member.

2. A uniroll device is claimed in claim 1, said driven member circular segments each having a cylindrical yarn-engaging periphery.

3. A uniroll device as claimed in claim 1, said driven member circular segments each having a convex yarn-engaging periphery.

4. A uniroll device as claimed in claim 1, said driven member circular segments each having a concave yarn-engaging periphery.

5. A uniroll device as claimed in claim 1, said yarn guide means including a yarn-engaging pin projecting inwardly between adjacent spaced-apart segments.

6. A uniroll device as claimed in claim 1, said yarn guide means being adjustably positioned adjacent said driven member depending upon the desired angle of yarn contact with each circular segment.

7. A uniroll device as claimed in claim 1, an inlet yarn guide means for presenting a yarn to said member at the desired angular position of contact.

8. A uniroll device as claimed in claim 7, an outlet yarn guide means for removing said yarn from said member at the desired angular position of discharge from said member.

9. A uniroll device as claimed in claim 1, adjustable yarn inlet and outlet guide means for presenting a yarn to said member at a desired angular position of contact and for removing said yarn from said member at a desired angular position for discharge from said member.

10. A uniroll device as claimed in claim 1, and means projecting from said device for driving said member.

11. A uniroll device as claimed in claim 1, a yoke bracket for bearingly supporting said member for rotation about its axis.

12. The method of false twisting a continuously traveling synthetic yarn in which the yarn passes through a heating zone and the twist is set in a cooling zone after emerging from the heating zone by imparting a false twist with a rotatable driven uniroll multiple surface device comprising the steps of guiding yarn along a directed path of travel, displacing the yarn against said uniroll multiple surface device to form at least a partial continuous helical angle along its path of travel, contacting the displaced yarn at spaced increments by a series of rotating yarn contacting surfaces rotating at the same angular velocity, and guiding and urging said yarn to travel along a sustantially rectilinear helical non-undulating path formed by said uniroll multiple surface device, and introducing said continuously traveling yarn and removing said continuously traveling yarn at a predetermined angle of approach and departure relative to the uniroll multiple surface device.

* * * * *